United States Patent [19]

Istha

[11] 4,413,664

[45] Nov. 8, 1983

[54] CORD-LOCKING DEVICE

[75] Inventor: Johannis Istha, Utrecht, Netherlands

[73] Assignee: Verosol B.V., Enschede, Netherlands

[21] Appl. No.: 281,850

[22] Filed: Jul. 9, 1981

[51] Int. Cl.[3] ..... E06B 9/38

[52] U.S. Cl. ..... 160/178 C

[58] Field of Search ..... 160/78 C, 178 R, 173

[56] References Cited

U.S. PATENT DOCUMENTS

| | | | |
|---|---|---|---|
| 2,449,583 | 9/1948 | Burns | 160/173 |
| 3,191,664 | 6/1965 | Hurkmans | 160/173 |
| 3,221,802 | 12/1965 | Hurkmans | 160/173 |
| 3,334,682 | 8/1967 | Eldredge | 160/178 R |
| 4,224,974 | 9/1980 | Anderson et al. | 160/178 R |
| 4,245,688 | 1/1981 | Vecchiarelli | 160/178 C |
| 4,271,893 | 6/1981 | McCluskey | 160/178 R |

FOREIGN PATENT DOCUMENTS

| | | | |
|---|---|---|---|
| 1232329 | 1/1967 | Fed. Rep. of Germany | 160/173 |

*Primary Examiner*—Peter M. Caun
*Assistant Examiner*—Cherney S. Lieberman
*Attorney, Agent, or Firm*—Kenyon & Kenyon

[57] ABSTRACT

A locking device for cords to hold a pleated shade or a venetian blind at a selected elevation comprises a U-shaped channel member and a housing covering one end of the channel member. A cradle integral with the channel member supports an axle on which congruent U-shaped cord-locking members are pivoted. The inner cord-locking member has a slotted bottom portion through which the cord extends to be gripped by the outer cord-locking member when the cord is pulled in one direction by the shade or blind, the cord-locking members releasing the cord in response to reverse tension. The cord is threaded through an opening in the bottom of the channel member and through the cord-locking members before assembly of the channel member and the housing together. The channel member and the housing have interlocking means to hold them attached to each other after assembly.

10 Claims, 7 Drawing Figures

CORD-LOCKING DEVICE

BACKGROUND OF THE INVENTION

1. Field of the Invention

This invention relates to the field of the cord-locking devices to lock the cord or cords controlling pleated shades, venetian blinds and similar blind and shade constructions. In particular, it relates to an improved cord-locking device comprising a channel member and a housing to permit the cord to be easily threaded into the channel member and then covered by the housing.

2. Prior Art

Cord-locking devices for venetian blinds frequently include teeth on a pivotally mounted member over which the cord runs. In normal use the cord may consist of two portions looped together to run closely parallel to each other, or it may include two separate cords running closely parallel to each other through the cord-locking device. By pulling on the cord or cords in the proper direction, the teeth can be caused to become disengaged from the cord or cords, and the member on which the teeth are formed may be caused to pivot out of the way so that the position of the venetian blind can be changed, for example by raising or lowering it. When it is desired to lock the blind in position, the person manipulating the blind brings the cord or cords into another position to engage the teeth of the locking device and draw those teeth into the locking position in which the cord or cords will be held by strong frictional engagement between the teeth of the locking device and a fixed portion of that device.

A locking device of the type just described has the disadvantage that it causes wear on the cord or cords due to the sharp points of the teeth and is frequently difficult to manipulate.

Another form of locking device is that shown in U.S. Pat. Nos. 3,191,664 and 3,221,802 in which there are two pivotally mounted members, both being generally U-shaped and one embracing the other. The inner of the two members has a slot through which the cords pass into a region between that member and the outer member. When the cords are pulled to raise the venetian blind, the two pivotally mounted members are separated from each other, which frees the cords to move. When the blind is to be locked in position, a small frictional engagement between the cords and the inner member allows the cords to draw the inner member up sufficiently into alignment with the outer member to provide a wedging action that grips the cords and holds them firmly in place by virtue of the tension supplied by the weight of the venetian blind.

The structure described and shown in those patents has the axle for the locking members fixedly mounted in a folded, U-shaped bracket made of sheet metal. That axle is located parallel to the axle of a guide pulley around which the cords curve from a horizontal direction to a vertical direction and thus perpendicular to any run of the cord. A housing over the bracket would make it difficult to thread the cords through the locking and guiding mechanism, and the patents do not suggest any such housing.

OBJECTS AND SUMMARY OF THE INVENTION

It is one of the objects of the present invention to provide a simplified and easily assembled cord-locking device.

Another object is to provide a cord-locking device that may be easily assembled and easily threaded.

Still another object is to provide a cord-locking device in which the cord may be pulled slightly away from the wall to engage the locking members.

Yet another object is to provide a simple, symmetrical structure for a cord-locking device that will permit the device to be used on either end of a pleated shade, venetian blind, and other blind and shade constructions in which the cord is to be held against a force that tends to move the shade or blind in one direction and thereby to pull the cord through the locking device.

A further object is to provide a cord-locking device that may be easily attached to the end of such a shade or blind.

A still further object is to provide a cord-locking device especially suited to be molded of plastic and comprising two basic, stationary members, one of which received the cord easily and the other of which is a housing that can be locked onto the first member after the cord has been threaded into the first member, and two U-shaped movable members to grip the cord or release it easily, the configurations of the stationary and movable members resulting in a simplified assembly.

In accordance with the present invention, the cord-locking device for a movable blind or shade includes a generally U-shaped channel member that has an opening in its bottom portion through which the cord passes. It will be understood that, hereinafter in this specification and the following claims, the term "cord" will be used to indicate either one or more cords unless the description specifically states otherwise. In addition, the term "force-actuated shade" used hereinafter includes pleated shades, venetian blinds, and other shades and blinds subjected to a force, such as gravity, that tends to move the shade or blind in one direction that would pull the cord through the locking device.

A U-shaped axle support is integrally formed with the channel member to receive an axle that may be placed therein with minimal effort, as if the axle were being placed in a cradle. The direction of the axle is preferably parallel to the channel member so that the axle supports can be molded symmetrically on each side of it to facilitate using the device on either end of the blind or shade.

Two U-shaped cord-locking members, one slightly larger than the other, are pivotally mounted on the axle so that the larger cord-locking device embraces the smaller one but with a space or gap between them wide enough to allow them to pivot indepentently of each other. However, the width of the gap is smaller than the diameter of the cord. The smaller, inner cord-locking member has a slot in its bottom portion through which the cord is threaded. One end of the cord extends longitudinally along the channel and out the far end to the force-actuated shade to be controlled by the cord. The other end of the cord hangs down in the usual manner.

Placing the axle of the cord-locking members parallel to the channel member makes it convenient to form several openings in the bottom of the channel member above the cord-locking members to provide separate passages for several cords.

When the hanging end of the cord is pulled to move the force-actuated shade against that force, the tension in the cord pushes the U-shaped cord-locking members apart and allows the cord to be pulled freely through the slot in the smaller member. After the force-actuated shade has been raised to the desired position, which usually means being moved to the desired height, most of the tension on the hanging cord is relaxed. If this cord is pulled in a direction that slants somewhat outwardly from the window covered by the force-actuated shade, causing the cord to touch the outer cord-locking member, any movement by the cord upwardly between the cord-locking members due to the actuating force, e.g., gravitational pull on the force-actuated shade, will create enough friction to force both of the cord-locking members towards an overlapping position. As a result the cord will be squeezed between them tightly enough to hold the force-actuated shade in place and keep it from moving any farther.

The channel member has a housing that covers a region in which the axle rests. It also covers the pivotal cord-locking members. However, the cord may be threaded through the channel and the cord-locking members before the housing is put in place, thus making it much easier to thread the cord through the apparatus. This is especially important if there are three or four or more cords that have to pass through the device. The channel member and the housing are provided with interlocking elements so that once the housing has been put in place, it cannot easily be removed. The channel member is provided with a latching groove that allows the locking device to be fitted as an endcap on the upper rail that is typically a component of a pleated shade or venetian blind actuated by the force of gravity. Fitting the locking device as an endcap avoids the necessity of any separate mounting for the locking device. However, the locking device can also be installed to be perpendicular to the rail or separate therefrom. For example, it can be installed in the frame of a window in which a blind is located between two panes.

DETAILED DESCRIPTION OF THE INVENTION

Figure 1:
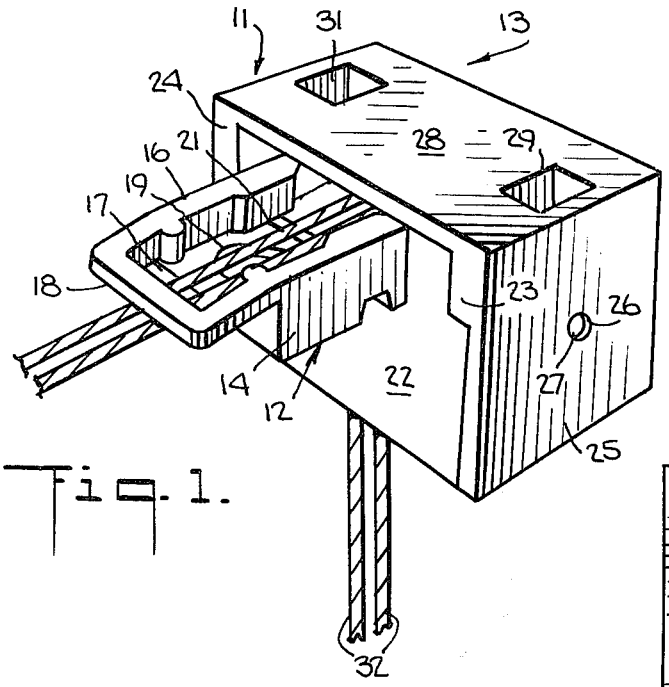
FIG. 1 shows a perspective view of a cord-locking device according to the present invention.

FIG. 1 shows a cord-locking device 11 including a channel member 12 and a housing 13. Both the channel member and the housing are molded of a suitable plastic strong enough to withstand the stresses in use and rigid enough to allow the two parts to be snapped together, but flexible enough to allow the bending required when one part is snapped onto the other. A suitable plastic is a polyamide. The channel member includes a channel generally U-shaped in cross section having two sides 14 and 16 parallel to each other joined together by a generally flat bottom member 17. A bridge 18 extends across one open end of the U-shaped channel member 12 near the open upper edge of the sides 14 and 16 to strengthen the channel member. The bottom 17 has a round opening 19 through which a fastener (not shown) may be inserted to hold the cord-locking device in place on some other structure (also not shown). In addition to the round opening 19, there is a slot 21 in the bottom 17 to provide further means for engagement between the channel member 12 and a supporting structure, such as the rail (not shown) typically located at the top of pleated shades and venetian blinds. The device shown in FIG. 1 may be coupled to the supporting structure or top rail as an end cap. The top rail would, for example, abut the open side of the housing 12 which is to the left of the housing 12 in FIG. 1. An end of this slot may be seen in the lower edge of the side 14 near a plate 22 which may be integrally joined to the channel member 12 and which forms a closure for one side of the housing 13. Except for the plate 22 and two corner portions 23 and 24, this side of the housing would be almost entirely open.

There is, in one side 25 of the housing 13, a round opening 26 in which a projection 27 fits to hold the housing 13 firmly attached to the channel member 12. Although it cannot be seen in FIG. 1, the housing 13 has another side directly opposite the side 25 and another opening in that unseen side corresponding to the opening 26 to receive a projection corresponding to the projection 27. The top surface 28 of the housing has two recesses 29 and 31 corresponding to internal abutments that will be described hereinafter. The recesses 29 and 31 allow substantially uniform wall thickness to be maintained in the housing 13 in accordance with good plastic molding practice. Two lengths of cord 32 are shown threaded through the cord-locking device 11, although more cords may be accommodated. One end of the cord extends longitudinally along the U-shaped portion of the channel member 12 and the other end of the cord hangs down vertically below the cord-locking device 11.

Figure 2:
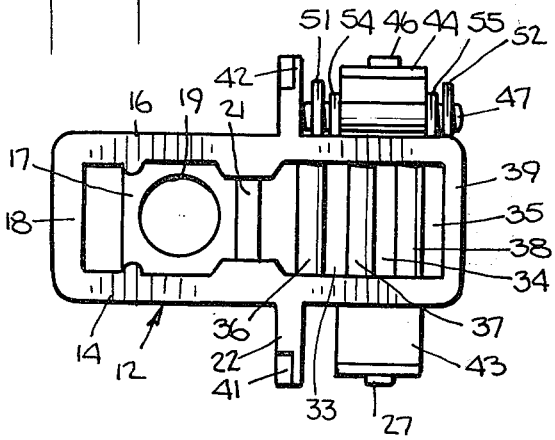
FIG. 2 is a top plan view of the channel member in the cord-locking device in FIG. 1.

FIG. 2 shows the U-shaped channel member 12 with both the housing and cord of FIG. 1 removed so that the end of the U-shaped channel that was covered in FIG. 1 can be seen. In this end of the channel are three slots 33–35 formed in the bottom 17 of the channel member. The portions of the bottom indicated by reference numbers 36–38 are cylindrically rounded to minimize any friction with the cord, and the provision of several slots allows the device to accommodate up to nine or even more cords and to guide them and keep them spread out so that they will not get tangled on each other. To strengthen the U-shaped channel member, a wall 39 is integrally formed across the end opposite the end at which the bridge 18 is located.

The wall 22 is shown as having two inserts 41 and 42 to allow corners of the wall 22 to interfit with the corner members 23 and 24 (FIG. 1) and adjacent structure of the housing 13. As such, these insets and the corner members of the housing that receive them strengthen the unitary structure formed when the housing 13 is attached to the channel member 12.

Figure 3:
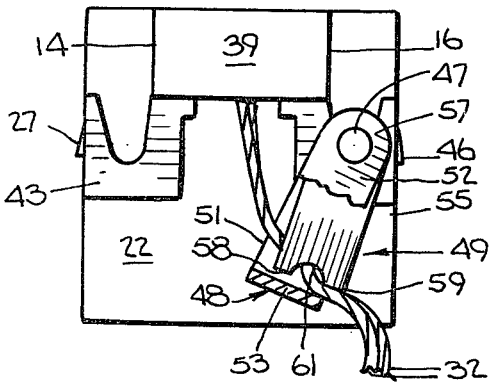
FIG. 3 is an end view of the channel member in FIG. 2 with part of the components shown broken away to make to path of the cord visible.

Two symmetrical axle supports 43 and 44 extend outwardly from the walls 14 and 16 of the channel member 12. The projection 27 is shown as being formed at the outermost surface of the axle support 43, and a similar projection 46 is formed at the outermost surface of the axle support 44. Projections 27 and 46 may be, for example, wedge-shaped or saw-tooth shaped as viewed from the side as shown in FIG. 3 to allow ease of assembling the channel member to the housing but difficulty in disassembling them. An axle 47 is placed in the axle support 44, as shown in both FIGS. 2 and 3, but the axle could just as easily be placed in the other support 43, so that the device 11 can be used either at the right or the left end of a force-actuated shade. This axle extends parallel to the longitudinal direction of the channel member 12 and has a length substantially equal to that portion of the channel member between the wall 22 and the end of the channel member at which the wall 39 is located.

As may be more easily seen in FIG. 3, each of the symmetrical axle supports 43 and 44 is a generally U-shaped structure, which makes it easy to place the axle 47 in either one of them. The axle 47 has two U-shaped cord-locking members 48 and 49 pivotally mounted on it. The cord-locking member 48 is made of a strip of sheet metal bent in to a U-shaped configuration and having two preferably flat arms 51 and 52 with part of the arm 52 being shown broken away in FIG. 3. A flat bottom strip joins the outer ends of the arms 51 and 52.

Figure 5:
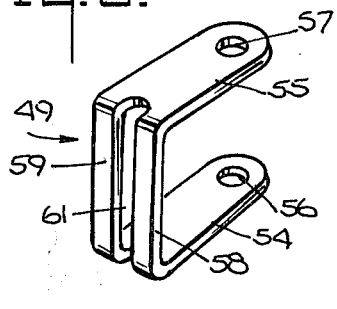
FIG. 5 shows one of the cord-locking members.

The smaller, inner cord-locking member 49 is shown more clearly in FIG. 5 and may also be formed of a strip of sheet metal bent into a U-shaped configuration congruent with the cord-locking member 48. The member 49 has two preferably flat arms 54 and 55 provided with holes 56 and 57, respectively, to be freely pivotal on the axle 47 (FIG. 2). The ends of the arms 54 and 55 remote from the apertures 56 and 57 are joined together by a flat part of the sheet metal strip separated into two portions 58 and 59 to define a slot 61 therebetween.

As may be seen in FIG. 3, the cord 32 is threaded through this slot and into the region between the portion 59 of the cord-locking member 49 and the inner surface of the bottom portion 53 of the cord-locking member 48. The cord 32 is shown without any tension on the upper part of it such as to pull both the cord 32 and the cord-locking member 48 and 49 upwardly. There is a small space between the portions 58 and 59 of the cord-locking member 49 and the inner surface of the portion 53 of the cord-locking member 48. However, the space between the portion 59 of the cord-locking member 49 and the inner surface of the portion 53 is not as great as the thickness of the cord 32 when the cord-locking members 48 and 49 are brought more nearly into alignment with each other. By arranging the members 48 and 49 so that their axle is parallel to the longitudinal direction of the channel member 12, the cords 32 are spread out along the flat part of the cord-locking members 48 and 49 between their respective arms by the slots 33–35 (FIG. 2), which helps keep the cords separate.

Figure 4:
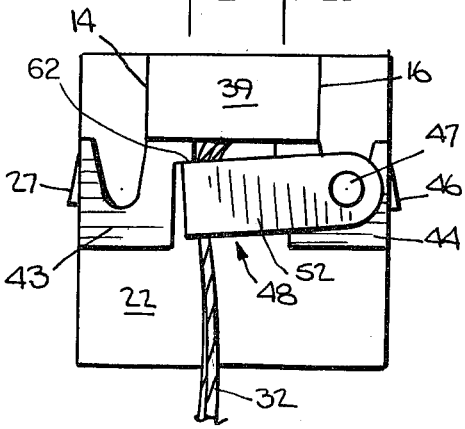
FIG. 4 shows the same end of the channel member as FIG. 3 with the cord-locking members in locked position.

FIG. 4 shows a condition of such complete alignment of the members 48 and 49 due to tension of the upper end of the cord 32 as to cause the inner cord-locking member 49 to be hidden within the outer cord-locking member 48. The members 48 and 49 exert a strong wedging action when so aligned to hold the cord 32 tightly. The force drawing the cord 32 upwardly in FIG. 4 is sufficient to cause the cord-locking member 48 to engage an abutment 62 to limit the clockwise pivoting motion of the cord-locking members .

A further fact to be noted about the cord-locking members 48 and 49, especially as shown in FIG. 3, is that the strips of metal of which they are formed are wide enough so that some pressure must be placed on the axle 47 to force the rounded ends of the arms 51 and 52 of the cord-locking member 48 and the arms 54 and 55 of the cord-locking member 49 under the lower edge of the wall 16. This means that the axle 47 and the cord-locking members 48 and 49 attached to it cannot easily fall out of the U-shaped axle support 44, once these elements have been assembled, even before the housing 13 (FIG. 1) is placed over them. There is only slight engagement between the rounded ends of the arms of the cord-locking members 48 and 49 and the lower edge of the wall 16, so it is not difficult to remove the cord-locking members and the axle 47 to which they are attached, but it is sufficiently difficult so that these parts will not be too easily separated during assembly of the device.

Figure 7:
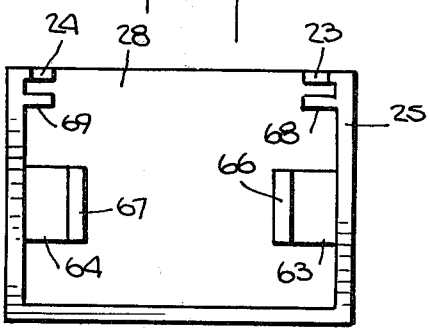
FIG. 7 shows a bottom view of the housing in FIG. 6.
Figure 6:
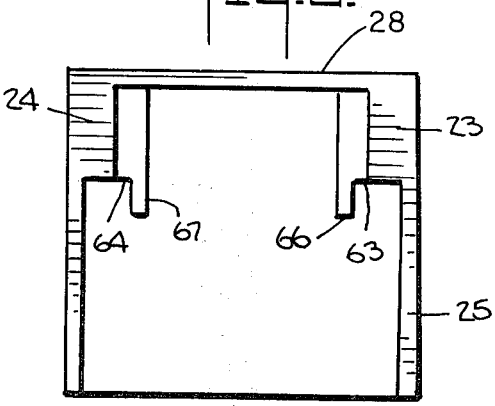
FIG. 6 is a front view of the open end of the housing shown in perspective view in FIG. 1.

The housing 13 shown in FIGS. 6 and 7 includes the side wall 25 and top wall 28 and the corner members 23 and 24 shown in FIG. 1. In addition, two abutments 63 and 64 extend downwardly from the top 28 and have narrow holding members 66 and 67 in positions directly over the U-shaped axle supports 43 and 44. The purpose of these holding members is to hold the axle more firmly in place in either axle support once the housing 13 has been snapped onto the channel member 12. Although there is only one axle, two axle supports and two abutments are provided to allow the axle to be put on either side of the channel element 12.

As shown in FIG. 7, particularly, two additional walls 68 and 69 extend perpendicularly from the inwardly facing surface of the top 28 parallel to the corner members 23 and 24 to form channels into which the edges of the wall 22 (FIG. 2) can fit. This allows the corner members 23 and 24 to fit into the insets 41 and 42.

While this invention has been described in terms of a specific embodiment, it will be understood by those skilled in the art that modifications may be made therein within the scope of the following claims.

What is claimed is:

1. A cord-locking device for cord operated window blinds adapted for use as an end cap of the upper rail supporting the blind, comprising:

a channel member generally U-shaped in cross section having two sides, a bottom, an open top and first and second ends and being elongated in a horizontal direction between the first and second ends;

an opening through the bottom of the U-shaped channel member adjacent the first end to permit the cord to pass therethrough, the direction of the cord being substantially vertical below said opening, the direction of said cord above said opening being horizontal along the direction of the open top of said channel, said cord disposed in the open top of said channel and exiting from said second end and being operative to lift or lower the window blind;

a U-shaped axle support integral with the channel member, said axle support having an open top, the open top extending in the longitudinal direction of the U-shaped channel member alongside the U-shaped channel member;

an axle disposed horizontally in the axle support parallel to the longitudinal direction of said channel member;

a housing covering at least part of the channel member adjacent the first end thereof;

a first U-shaped cord-locking member comprising side portions pivotally mounted on the axle, a bottom portion extending between the two side portions, and a cord opening through the bottom portion;

interlocking means interlocking the housing with the channel member to hold the housing firmly but removably attached to the channel member whereby when said housing is removed from said channel member, said cord is easily threaded through said cord opening in said first cord-locking member and said opening in said channel member, said housing being interlocked with said channel member after said cord is threaded therethrough; and a second U-shaped cord-locking member comprising side portions pivotally mounted on the axle and a bottom portion substantially parallel to the bottom portion of the first member, the second U-shaped cord-locking member embracing the first cord-locking member and being spaced therefrom by a distance less than the thickness of the cord to prevent the cord from sliding relative to the U-shaped cord-locking members when the cord extends through the opening in the first cord-locking member and the second U-shaped cord-locking member overlaps the first U-shaped cord-locking member, the cord-locking members being pivotally separable by pulling the cord in a downward direction and being forced back together toward a locked position by pulling said cord at an angle from said downward direction away from said window blind thereby causing said cord-locking members to pivot upwardly toward said locked position, the tension on the cord due to the weight of the window blind in the upward direction causing said cord-locking members to reach said locked position.

2. The invention as defined in claim 1 in which the opening through the bottom of the U-shaped channel member is substantially aligned with the bottom portions of the cord-locking members when the cord-locking members are in the locked position.

3. The invention as defined in claim 1 comprising, in addition, a second U-shaped axle support formed integrally with the channel member and being symmetrical with the first-named U-shaped axle support on the opposite side of the channel member.

4. The invention as defined in claim 3 in which the interlocking means comprising:

wedge shaped members on the surfaces of the U-shaped axle supports facing in mutually opposite directions; and recesses in opposite sides of the housing juxtaposed with respect to the wedge shaped members when the channel member and the housing are locked together, whereby the channel member can be snapped together much more easily than they can be separated.

5. The invention as defined in claim 1 comprising, in addition, a plate integrally molded of plastic with the channel member and located intermediate the ends of the channel member extending outwardly on each side of the channel member, the plate comprising part of the interlocking means between the housing and the channel member.

6. The invention as defined in claim 6 in which the housing is also molded of plastic and comprises wall portions defining an opening therein and a channel adjacent the opening to receive the plate.

7. The invention as defined in claim 6 comprising, in addition:

a second U-shaped axle support formed integrally with the channel member and symmetrically with respect to the first-named channel member, the distal portions of the U-shaped axle supports comprising wedge-shaped surfaces comprising part of the interlocking means, the housing further comprising recesses in opposite walls thereof to receive the wedge-shaped surfaces when the channel member and the housing are assembled together.

8. The invention as defined in claim 1 in which the side portions of both of the cord-locking members are substantially straight and parallel to each other, and the bottom portions of both of the cord-locking members are substantially straight and perpendicular to the side portions of the respective cord-locking members, the cord opening comprising a central slot extending along the bottom portion of the first U-shaped cord-locking member and extending from one of the side portions of that member of the other side portion thereof.

9. The invention as defined in claim 1 wherein said axle is removably disposed in said axle support, further comprising, means for holding said axle in place in said axle support.

10. The invention as defined in claim 9 wherein said means for holding comprises a projection extending from said housing which presses said axle firmly in said axle support.

* * * * *

UNITED STATES PATENT AND TRADEMARK OFFICE

CERTIFICATE OF CORRECTION

PATENT NO. : 4,413,664

DATED : November 8, 1983

INVENTOR(S) : JOHANNIS ISTHA

It is certified that error appears in the above—identified patent and that said Letters Patent is hereby corrected as shown below:

Col. 8, line 17, change "6" to --5--.

Signed and Sealed this

*Tenth* Day of *January 1984*

[SEAL]

*Attest:*

GERALD J. MOSSINGHOFF

*Attesting Officer*

*Commissioner of Patents and Trademarks*